US006660924B2

(12) United States Patent
Okamura et al.

(10) Patent No.: US 6,660,924 B2
(45) Date of Patent: Dec. 9, 2003

(54) AUTOMATIC PLAY APPARATUS AND FUNCTION EXPANSION DEVICE

(75) Inventors: Yasuhiko Okamura, Hamamatsu (JP); Gary Gregson, Hamamatsu (JP); Kenichiro Saito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/209,713

(22) Filed: Jul. 31, 2002

(65) Prior Publication Data

US 2002/0189428 A1 Dec. 19, 2002

Related U.S. Application Data

(62) Division of application No. 09/726,715, filed on Nov. 30, 2000.

(30) Foreign Application Priority Data

Dec. 6, 1999 (JP) ..... 11-346784

(51) Int. Cl.[7] ..... A63H 5/00; G04B 13/00; G10H 7/00

(52) U.S. Cl. ..... 84/609; 84/645

(58) Field of Search ..... 84/600–604, 609, 84/634, 645

(56) References Cited

U.S. PATENT DOCUMENTS

| | | | | |
|---|---|---|---|---|
| 4,953,438 A | | 9/1990 | Shibukawa | |
| 5,340,939 A | | 8/1994 | Kumagai | |
| 5,565,640 A | | 10/1996 | Hasebe | |
| 5,672,837 A | | 9/1997 | Setoguchi et al. | |
| 5,763,800 A | | 6/1998 | Rossum et al. | |
| 5,777,250 A | * | 7/1998 | Aoyama et al. | 84/609 |
| 6,023,016 A | | 2/2000 | Tamura | |
| 6,023,017 A | * | 2/2000 | Minowa et al. | 84/637 |

FOREIGN PATENT DOCUMENTS

| | | |
|---|---|---|
| EP | 0 235 768 | 9/1987 |
| GB | 2 133 198 A | 7/1984 |
| GB | 2 209 425 A | 5/1989 |
| JP | 11-109972 | 4/1999 |

* cited by examiner

*Primary Examiner*—Jeffrey Donels
(74) *Attorney, Agent, or Firm*—Morrison & Foerster LLP

(57) ABSTRACT

In an automatic play apparatus for electronic music system, it is often desired to expand its function in universal and easy way. In this invention, at steps 100–140, the sequencer module records music performance data provided from an external device or it reproduces them. Sometimes it does both at the same time. In a series of processing at steps 100–140, the queue processing 200, 300 and 400 are introduced. In each queue processing, a part of the music performance data is memorized temporarily in Temporary Memory Area 200*a*, 300*a* and 400*a*, and the pointer, as an argument, corresponding to the memorized part of the music performance data is transferred to various plug-in programs which work as function expansion modules. The plug-in programs are thus enabled to read out the music performance data and write them, respectively from and in Temporary Memory Area 200*a*, 300*a* and 400*a*.

13 Claims, 12 Drawing Sheets

AUTOMATIC PLAY APPARATUS AND FUNCTION EXPANSION DEVICE

This application is a division of application Ser. No. 09/726,715, filed on Nov. 30, 2000.

BACKGROUND OF THE INVENTION

1. Field of the Invention

The present invention relates to an automatic play apparatus for an electronic music system recording and reproducing a series of music performance data, and more particularly to an automatic play apparatus to which additional functions can universally and easily be applied, to a function expansion device for the automatic play apparatus, and to a storage medium memorizing computer readable programs prepared for the automatic play apparatus and the function expansion device.

2. Description of the Related Art

It is already known that various kinds of automatic play apparatus like so-called sequencer have existed in a form of stand-alone apparatus or have been integrated into electronic musical instruments, personal computers etc. Such an automatic play apparatus, as its proper function, memorizes music performance data given from an external device in a storage device, and reproduces music performance data memorized there. An automatic play apparatus has also a function of editing by which users can modify, add and suppress once stored music performance data.

However, a further expansion of the function of an automatic play apparatus has come to be desired when the music performance data given from an external device is memorized in or reproduced from the music performance data storage device. The expanded function, e.g. to monitor the streaming music performance, to add other music performance data to the memorized music performance data and/or to modify a part or all of the music performance data, is very difficult to realize in above-mentioned existing automatic play apparatuses except for a limited number of users who are exceptionally well-trained regarding technologies of the automatic play system architecture, and the music performance data structure etc. This is because existing automatic play apparatuses are composed in different system structures and users have to treat different music performance data structures depending on manufacturers and/or product models.

Accordingly, even when an user tried to expand the function of an existing automatic play apparatus by adding his new contrivance, it was not easily realized and the total function of the automatic play apparatus was therefore obliged to stay in a limited range. Moreover, due to a complicated variety of manipulating ways of automatic play apparatuses depending on manufacturers and product models, users had to learn different manipulating ways every time when he had to handle a non-experienced product model. As this is also true when users try to edit all or a part of music performance data stored in the music performance storage device, it was impossible for ordinary users to edit the music performance data in an universal (=common) and easily understandable way.

SUMMARY OF THE INVENTION

The present invention is to resolve the above-mentioned insufficiency of existing automatic play apparatuses, by introducing to them a function expansion device to which new functions can be universally and easily applied and by introducing a storage medium memorizing computer readable programs relating to an automatic play apparatus.

A feature of this invention pertains to "queue means" introduced in an automatic play apparatus which records and reproduces a series of music performance data in a series of processing with elapse of time. The queue means memorizes temporarily, in a memory area, a part of music performance data extracted from a series of music performance data during the series of processing. The queue means also transfers to a function expansion module a pointer, as argument address, corresponding to the part of music performance data memorized in the memory area in order to transfer the music performance data to the function expansion module, and permits the function expansion module to read out the music performance data from the memory area by the function expansion module and to write newly established music performance data in the memory area.

According to the above-described feature of this invention, it is possible to adopt a function expansion module for an automatic play apparatus only by implementing the function expansion module (either by software or hardware) which receives a pointer, as argument address, corresponding to music performance data memorized in the memory area and reads out music performance data from the memory area or writes music performance data into the memory area.

This function expansion module can receive the series of music performance data and can add new music performance data to the series of music performance data during the period when the automatic play apparatus records or reproduces a series of music performance data. Accordingly, when music performance data given from an external device is memorized in or reproduced from music performance data memory area, it becomes possible to expand capability of an automatic play apparatus universally and easily by adding such functions as monitoring actually streaming music performance data among the series of music performance data, adding new music performance data to existing music performance data, and modifying the music performance data.

In the other aspect, a feature of this invention can also be expressed as follows. It contains a function expansion device applied to an automatic play apparatus which records and reproduces a series of music performance data according to proper processing with elapse of time. The function expansion device contains data reading and writing means which reads out music performance data from a memory area and writes music performance data in the memory area, by receiving a pointer, as argument address, corresponding to a part of music performance data among a series of music performance data memorized in the memory area during a series of processing.

The function expansion device can thus be applied and added to the automatic play apparatus so that various new functions can be universally and easily installed.

Another feature of this invention is in the introduction of an interface means in an automatic play apparatus which controls, in triple layered data structure, a series of music performance data memorized in a music performance data memory area. Namely, the interface means reads out, among the series of music performance data, a part of music performance data designated by a function expansion module according to a mathematical function which treats the triple layered data, transfers the part of music performance data to a function expansion module, receives the music performance data, under the triple layered data structure, from the function expansion module, incorporates the music performance data into a series of music performance data memorized in the music performance data memory area.

The triple layered data structure is defined by track, block and event data for example. The track indicates each part of music performance, such series of musical sound data as melody, chord accompaniment, bass accompaniment, and rhythm sound. The block indicates a defined period such as a phrase or a measure of music score. The event data indicates control data for controlling the generation of a sound signal or a tone signal, such as key-on data, key-off data, timbre data and sound volume data.

According to this invention, it is only necessary to prepare a function expansion module which firstly designates for the interface means, using a mathematical function under the triple layered data structure, a part of music performance data selected from the series of music performance data, and secondly can receive and transfer music performance data, in order that the function expansion module can be applied and added to an automatic play apparatus. The function expansion module can be implemented by either hardware or software(=computer program).

As this function expansion module receives a series of music performance data memorized in a music performance data memory area and add new music performance data to the series of music performance data, it becomes possible to expand the function of an automatic play apparatus, e.g. universally and easily, to monitor a series of music performance data memorized in a music performance data memory area, to add new music performance data to the music performance data, and to modify the music performance data.

In the other aspect, a feature of this invention can be explained as follows with regard to a function expansion module. The function expansion module is applied to an automatic play apparatus which controls a series of music performance data memorized in music performance data memory area in triple layered data structure. It designates a part of the series of music performance data using a mathematical function under the triple layered data structure, receives the designated data from the automatic play apparatus, modifies the designated data, and transfers the modified data back to the automatic play apparatus under the format in accordance with the triple layered data structure.

By such application and addition of the function expansion device to the automatic play apparatus, it becomes possible to realize the various kinds of expansion of the function of an automatic play apparatus universally and easily.

Still another feature of this invention is found in the introduction of a computer readable storage medium which memorizes computer programs useful to realize the various functions. Either by installing the programs into such apparatuses as electronic musical instrument, personal computer, sequencer, or by integrating this medium itself into those apparatuses, the various functions can be added in the automatic play apparatus. Thus, the automatic play apparatus can expand their capability universally and easily.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
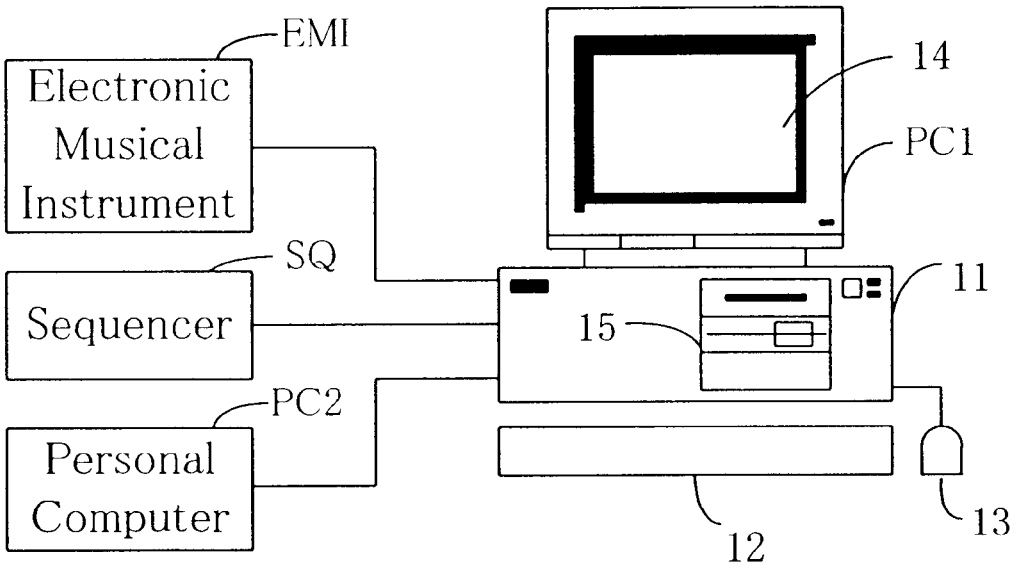
FIG. 1 shows a diagram of an embodiment of this invention applied to a personal computer which is connected with several apparatuses employed in the embodiment.
Figure 2:
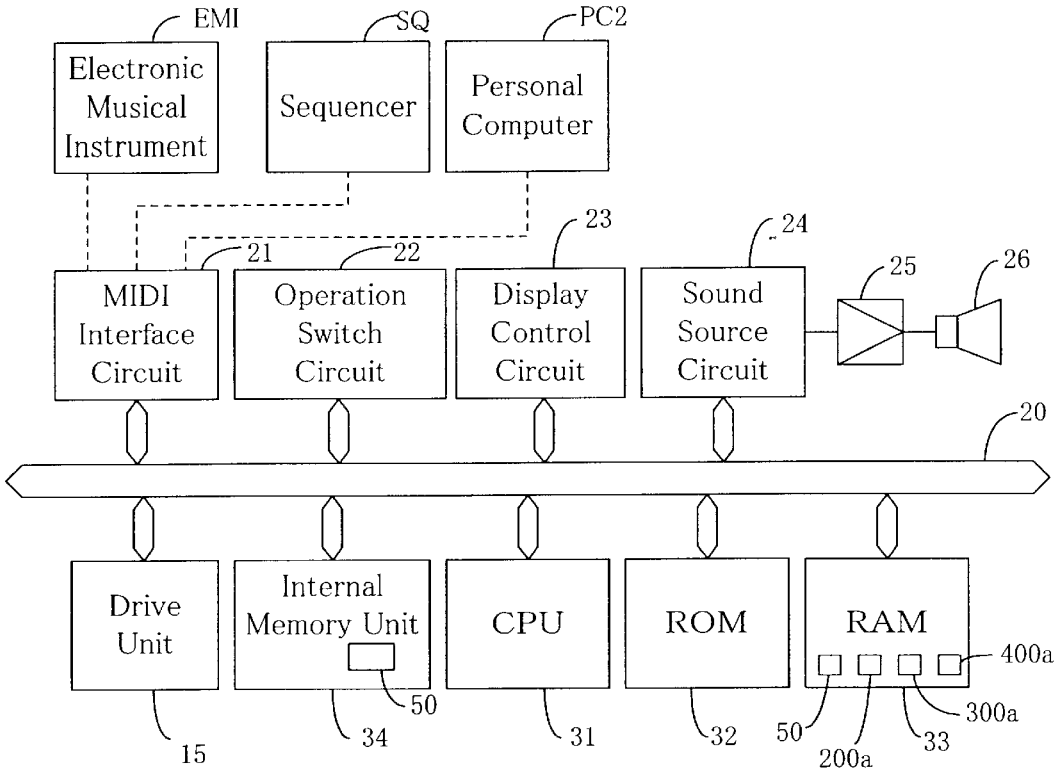
FIG. 2 is a similar diagram with FIG. 1, but showing a detailed structure of the personal computer in FIG. 1.

Now, a preferred embodiment of the present invention will be explained with reference to the accompanying drawings. FIG. 1 is a connection diagram of Personal Computer PC1 and various apparatuses as an embodiment of this invention where Personal Computer PC1 is used as a central unit of control, and FIG. 2 shows the same apparatuses as FIG. 1 with a detailed diagram of Personal Computer PC1 portion.

Personal Computer PC1, being installed with aftermentioned sequencer program and plug-in programs, works not only as automatic play apparatus but as function expansion device relating to this invention. Detailed explanation about the former will be given in a sequencer module portion, and the latter in a function expansion module portion, both in later description.

Personal Computer PC1 is connected, in this case, to Electronic Musical Instrument EMI, Sequencer SQ and Other personal Computer PC2. These apparatuses, Electronic Musical Instrument EMI, Sequencer SQ and Other Personal Computer PC2, are ordinarily existing apparatuses which can receive and transfer information under MIDI format from and to Personal Computer PC1. If other apparatuses such as electronic musical instrument, sequencer, can be installed with both the sequencer program and the plug-in programs and can work with these programs, they can be used in this embodiment instead of Personal Computer PC1. Such other apparatuses can also be ones to which the programs can be provided by means of flush ROM.

Personal Computer PC1 is a regular type of personal computers consisting of Main Body 11, Input Device like Keyboard 12 and Mouse 13, Display Unit 14 etc. The Main Body 11 is equipped at its front with Drive Unit 15, and is furnished at its back with connection terminals to connect Electronic Musical Instrument EMI, Sequencer SQ, Other Personal Computer PC2 etc. Drive Unit 15 is to be connected with more than one of external memory devices such as compact disk, flexible disk, in order to read out and write programs and data from and into the external memory devices.

The internal circuit apparatus integrated in Main Body 11 of Personal Computer PC1 is provided with MIDI Interface Circuit 21, Operation Switch Circuit 22, Display Control Circuit 23 and Sound Source Circuit 24, all of which being connected to Bus 20. The Drive Unit 15 is also connected to the same Bus 20.

MIDI Interface Circuit 21 enables transferring of music performance data under MIDI format to and from Electronic Musical Instrument EMI, Sequencer SQ and Other Personal Computer PC2 via the connection terminals provided at the back of Main Body 11. Operation Switch Circuit 22 is composed of switches corresponding to Keyboard 12 and Mouse 13, and it outputs signals according to operation of the Keyboard 12 and Mouse 13. Display Control Circuit 23 controls displaying status of Display Unit 14. Sound Source Circuit 24 includes a plurality of sound source channels which form musical sound signals made from music performance data(including timbre data, sound volume data, key-on data, key-off data, etc.) provided via Bus 20 and output the musical sound signals, and sound output circuit which synthesizes and outputs musical sound signals from each of sound source channels. The Sound Source Circuit 24 is connected to Amplifier 25 and Loud Speaker 26 to generate audible sound output from the synthesized and outputted musical sound signal.

To Bus 20 are also connected CPU 31, ROM 32 and RAM 33 composing principal portion of Personal Computer PC1 as well as its Internal Memory Device 34. CPU 31 executes various processing for music performance data by executing various programs and also controls generation of musical sound signals. Both ROM 32 and RAM 33 memorize the programs and various kinds of data. Internal Memory Device 34 consists of hard disk, driving device for the hard disk, etc. having a role of memorizing a large quantity of information.

In the next paragraph, it will be explained how the embodiment works when it is composed as above-described. First of all, a user prepares external storage medium such as compact disk, flexible disk storing sequencer program and various plug-in programs like MIDI monitor, playback, asynchronous, edition. The user loads the storage medium in the driving unit. Then the user installs the various programs in RAM 33 or in Internal Memory Device 34. It is also possible to memorize previously such programs either in ROM 32 or in Internal Memory Device 34, or use a flush ROM storing the various programs if the flush ROM is available in Personal Computer PC1.

After having accomplished this installation, the user starts up the sequencer program, and prepares to start up necessary plug-in programs or starts up the plug-in programs. The sequencer program contains both online processing routine and offline processing routine. The online processing routine records music performance data received from external device in Music Performance Data Memory Area 50 allocated in RAM 33 or in Internal Storage Device 34, reproduces them to output as musical sound, and enable the plug-in programs to execute while a series of music performance data stored in the Music Performance Data Memory Area 50 is being reproduced to output musical sound, namely while an automatic play is in operation. The offline processing routine enable the plug-in programs to execute while the automatic play is not in operation(in its suspended period). A more detailed description will be given in the following paragraph for each of online processing and offline processing.

a. Online Processing

Figure 3:
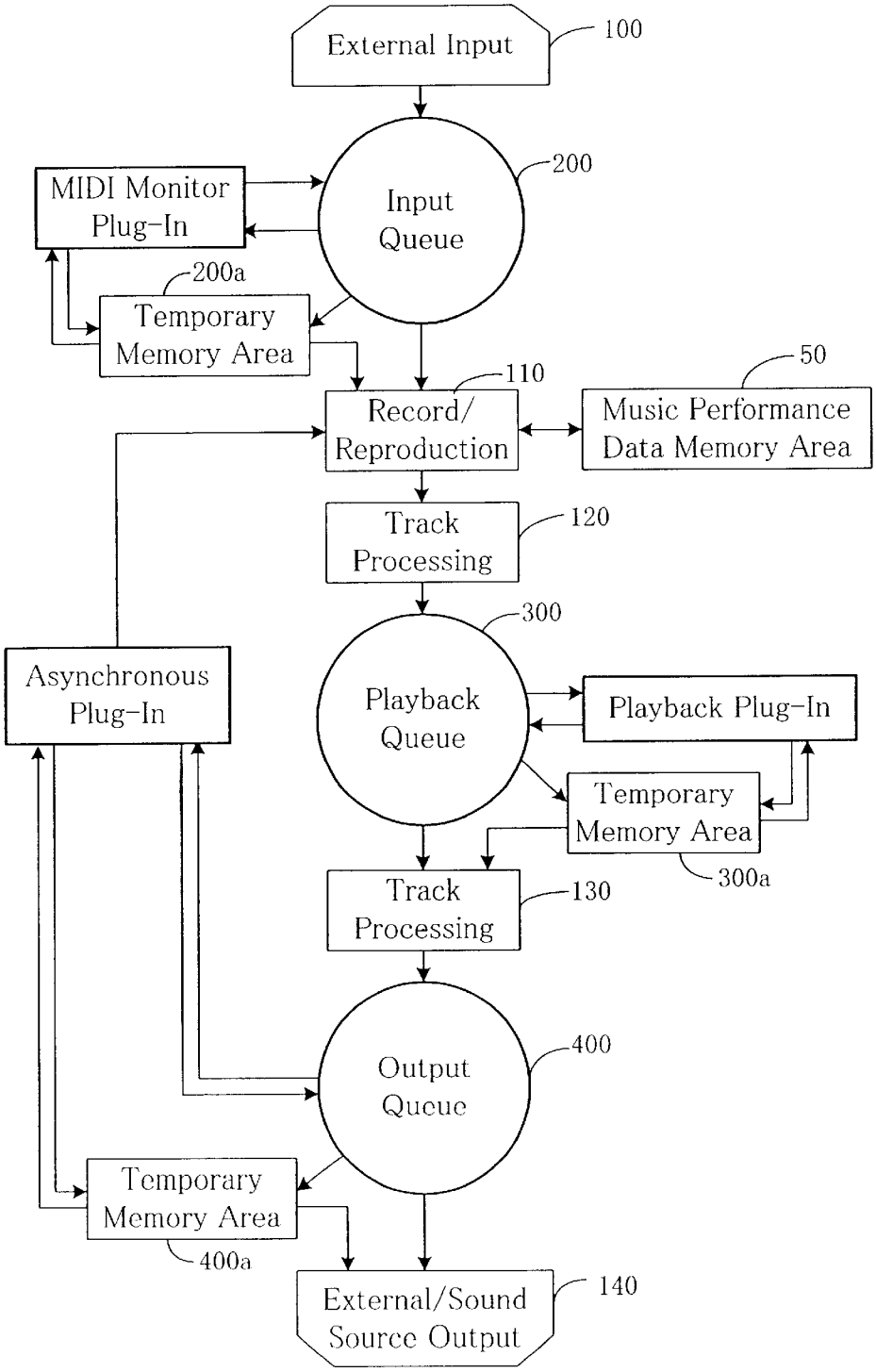
FIG. 3 is a flow chart of working process in the online processing case.

FIG. 3 shows a flow chart of the online processing. The online processing routine consists of already known processing steps and several additional steps relating to the present invention. The former includes processing of input from external device at step 100, processing of record/reproduction at step 110, processing of track at steps 120 & 130 and processing of external/sound source output at step 140. And the latter includes input queue processing at step 200, playback queue processing at step 300 and output queue processing at step 300.

The processing of input from external device at step 100 takes streaming music performance data which consecutively comes with musical elapse of time and comes from connected external devices such as Electronic Musical Instrument EMI, Sequencer SQ, Personal Computer PC2, into a sequencer module so that the data may be processed in the sequencer module. The term "sequencer module" here signifies an automatic play apparatus working with a sequencer program or a so-called sequencer unit. The record/reproduction processing at step 110 stores the music performance data received from external source in Music Performance Memory Area 50 and, at the same time, to advance program into the next step 120 of track processing for reproduction of the music performance data, and also reads out sequentially a series of music performance data stored in Music Performance Data Memory Area 50 according to musical elapse of time, and then to advance the program into the next step 120 of track processing for reproduction of the read out music performance data.

The track processing at steps 120 & 130 determines, with regard to each one of all tracks, whether or not music performance data recorded in the track should be reproduced, and controls to reproduce the performance data on the basis of the determination. This processing also determines, with regard to each one of all tracks, whether or not the performance data should be outputted to external devices, and controls to output the performance data to the external device. Furthermore, this processing changes music performance data in a certain track into those of a different track.

Figure 4:
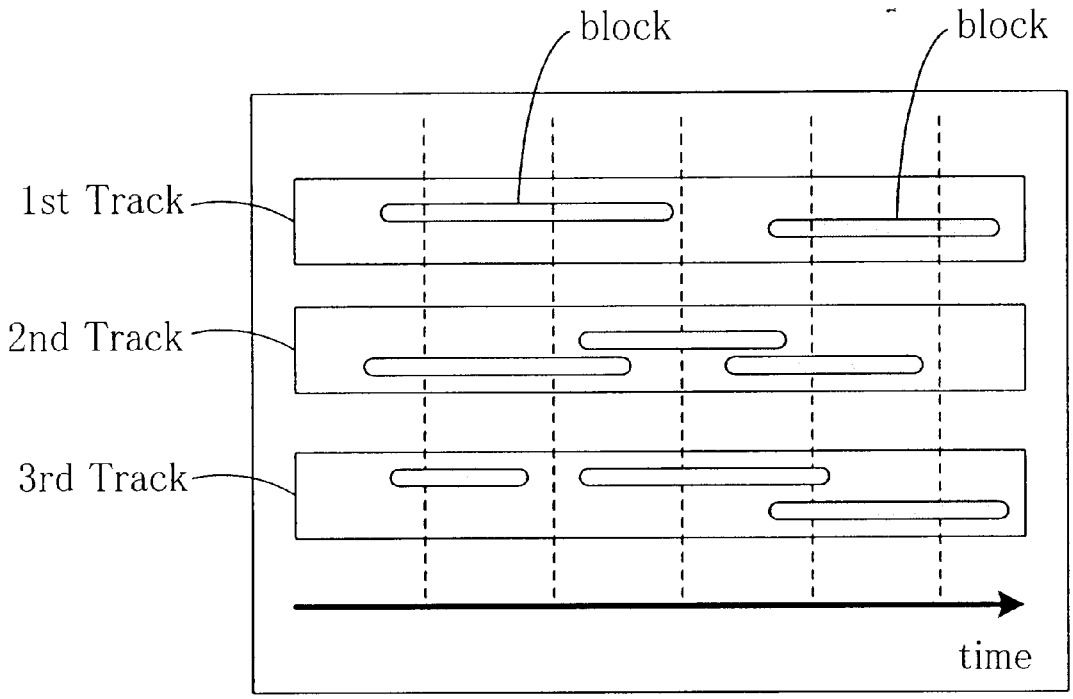
FIG. 4 is a diagram showing the data format of "triple layered data structure"

The format of music performance data, as shown in FIG. 4, has a prescription of triple layered structure composed of "track", "block", and "event data". The "track" indicates such series of musical sound data as melody, chord accompaniment, bass accompaniment, rhythm sound (=percussion sound), corresponding to one or plural sound source channels included in the Sound Source Circuit 24. Accordingly, the track processing results in determining existence(or non-existence) of sound generation or sound output with regard to each one of the series of sound, and in changing the sound source channel.

Figure 5:
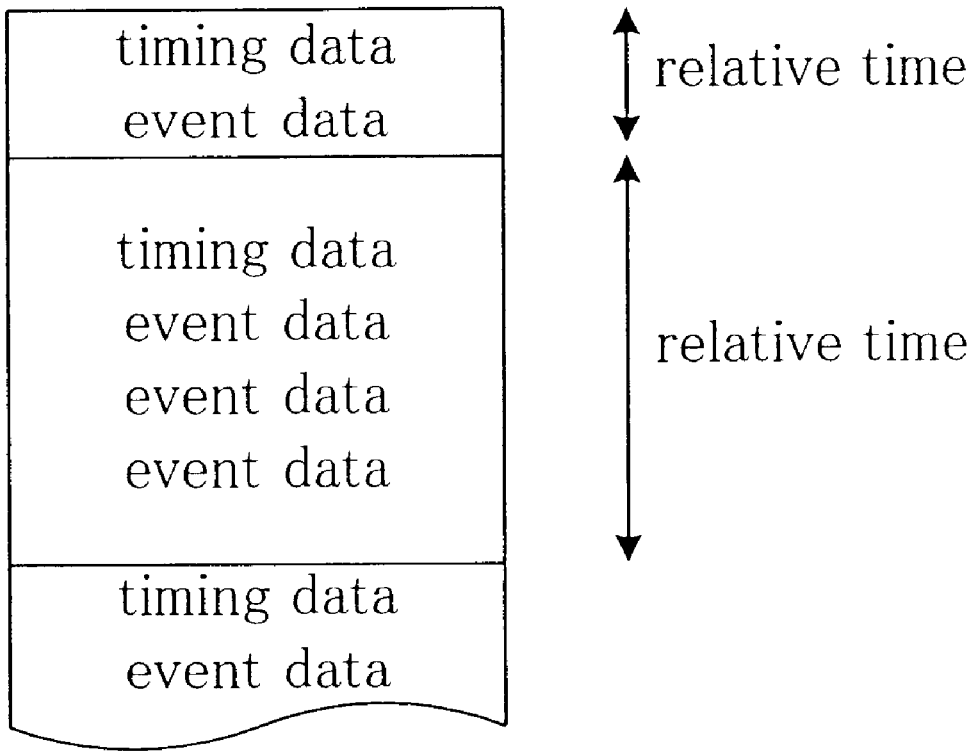
FIG. 5 is a diagram showing the data format of a series of music performance data.

The "block" consists of a plurality of event data of each track during a defined period such as a phrase or a measure (of music score). Event data have a role to wholly control musical sound generation, e.g. data determining timbre and pitch of a musical sound to be generated, key-on data and key-off data defining start and stop timing. As shown in FIG. 5 a series of music performance data is constructed from plural event data placed on a time axis. Each one of the event data corresponds to one or more simultaneously happening plural music performance events, following a timing data which signifies relative elapse of time from previous event data. The event data shown in FIG. 5 are additionally provided with track number and block number to distinguish proper track and block which each one of event data belongs to. It is possible to use other data format than this example shown in FIG. 5, i.e. without such track number or block number, if the format permits to distinguish proper track and block of each one of event data, namely if the triple layered data structure of a series of music performance data can be objectively recognized from outside.

External/sound source output processing of step 140 outputs music performance data via MIDI Interface Circuit 21 to various units connected to Personal Computer PC1 such as Electronic Musical Instrument EMI, Sequencer SQ, Personal Computer PC2. This processing also outputs music performance data to Sound Source Circuit 24 to generate musical sound signal corresponding to the music performance data.

The input queue processing in step 200 corresponds to the queuing means of this invention. This step 200 is set between the step 100 of external input processing and the step 110 of record/reproduction processing. In this step 200 a series of music performance data inputted from an external device by the external input processing is temporarily memorized, sequentially from one part of music performance data to another, in Temporary Memory Area 200*a* allocated in RAM 33. It is also executed in this step 200 to transfer the pointer, as argument address, regarding the memorized part of music performance data to a plug-in program which is in this case a function expansion module. Then the plug-in program is called up to read out music performance data from Temporary Memory Area 200*a* and to write music performance data in Temporary Memory Area 200*a*. Therefore, in the record/reproduction processing at step 110, the music performance data memorized in Temporary Memory Area 200*a*, which is written by input queue processing of step 200, is recorded an reproduced. It is also possible, on the other hand, for the plug-in program as a function expansion module to transfer common argument address to the input queue processing and to call up the input queue processing.

Figure 6:
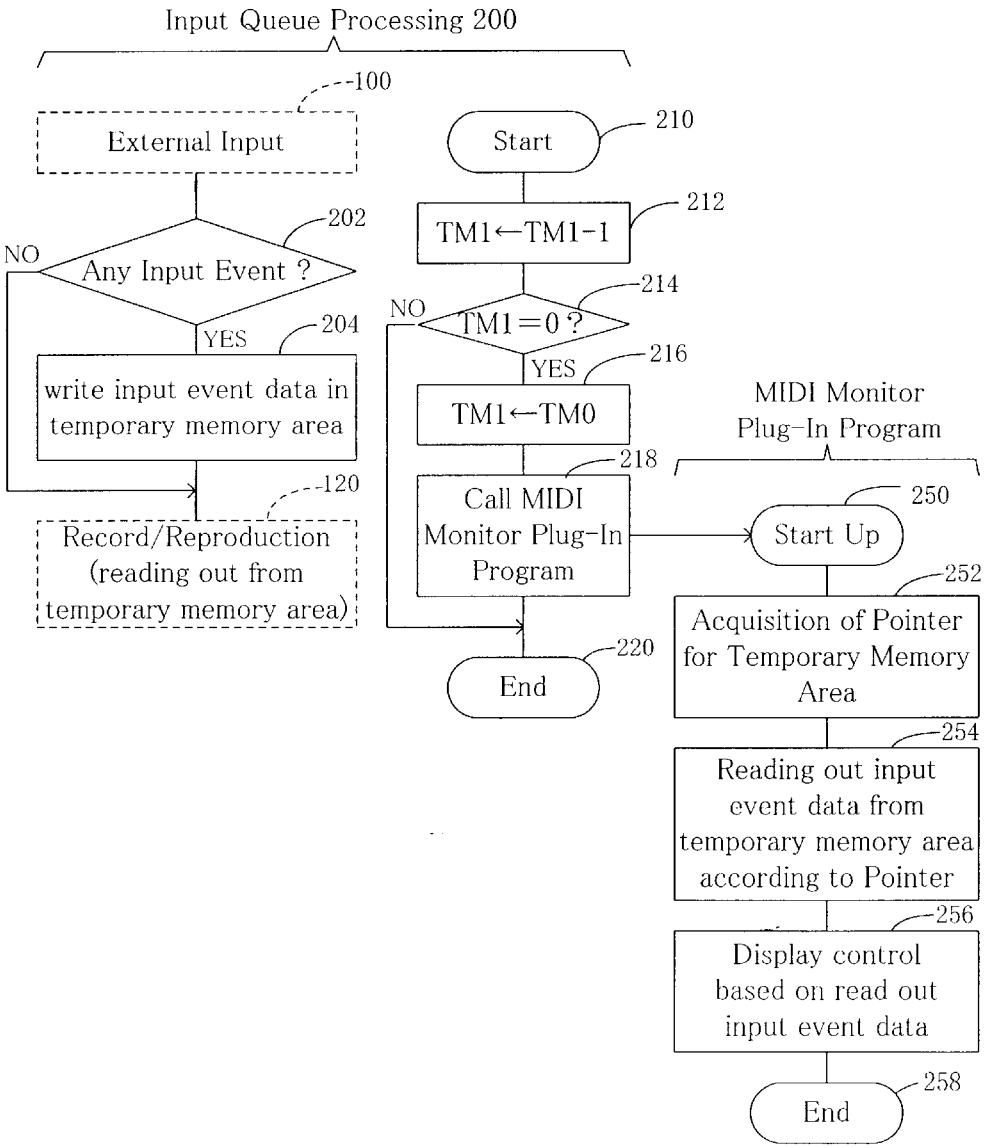
FIG. 6 is a flow chart showing the input queue processing and execution process of the MIDI monitor plug-in program.

An example of the input queue processing will be explained as follows. Both FIG. 3 and FIG. 6 show processing flow of the case when MIDI monitor plug-in program is additionally applied to a sequencer program. In the input queue processing at step 200, it is determined at step 202 whether or not new music performance data are inputted by external input processing of step 100, in other words, whether or not there is any event data of input at the step 100. If any event data of input are found, the determination becomes "YES" at step 202, and then the event data of input(=inputted musical performance data) are written in Temporary Memory Area 200*a* at step 204, to accumulate there the event data sequentially. If Temporary Memory Area 200*a* is filled with event data of input, the oldest data will then be erased. In case when no event data of input exist, then the determination at step 202 becomes "NO" to advance the program to step 120.

In the input queue processing of step 200, processing of steps 210–220 is executed repetitively at predetermined short time intervals, in parallel with the processing at steps 202 and 204. By subtraction processing of Time Count Value TM1 at step 212, time up detection processing at step 214 by comparing Time Count Value TM1 with "0(=zero)", and set up processing of Time Count Value TM1 by the designated value TM0 at step 216, the elapse of designated time corresponding to the designated value TM0 is measured. At each elapse of the designated time, the pointer regarding the event data of input memorized in the Temporary Memory Area 200*a* is transferred to MIDI monitor plug-in program as argument address, then the MIDI monitor plug-in program is called up at step 218. In other words, the MIDI monitor plug-in program is commanded to start up when the pointer is transferred to the program.

The execution of this MIDI monitor plug-in program begins with its starting up at step 250 by the calling up. It acquires then, at step 252, the pointer regarding event data of input(=inputted music performance data) memorized in the Temporary Memory Area 200*a*. At step 254, the event data of input memorized in Temporary Memory Area 200*a* are read out in accordance with the acquired pointer. At step 256 then, a display control signal corresponding to the read out event data is outputted to Display Control Circuit 23 based on the event data. The execution of the MIDI monitor plug-in program is completed at step 258. Display Control Circuit 23 controls Display Unit 14 in order to display music notes corresponding to the event data of input, characters signifying music notes etc. on Display Unit 14. The user can thus monitor on Display Unit 14 the music performance data inputted by the external input processing at step 100 of the sequencer program.

The playback queue processing at step 300 corresponds to queuing means of this invention and is located between two track processing steps of 120 and 130. In this step 300, a series of music performance data processed by the track processing at step 120 is temporarily memorized, sequentially from one part of music performance data to another, in Temporary Memory Area 300*a* allocated in RAM 33. It is also executed in this step 300 to transfer the pointer as argument address, regarding the memorized part of music performance data, to a plug-in program which is in this case a function expansion module. Then the plug-in program is called up to read out the music performance data from Temporary Memory Area 300*a* and to write music performance data in Temporary Memory Area 300*a*. Therefore, in the track processing at step 130, the track processing is executed by reading out the music performance data temporarily memorized in Temporary Memory Area 300*a* according to the playback processing at step 300. In addition, a plug-in program as a function expansion module can call up, on the other hand, the playback queue processing by transferring a common argument address.

Figure 7:
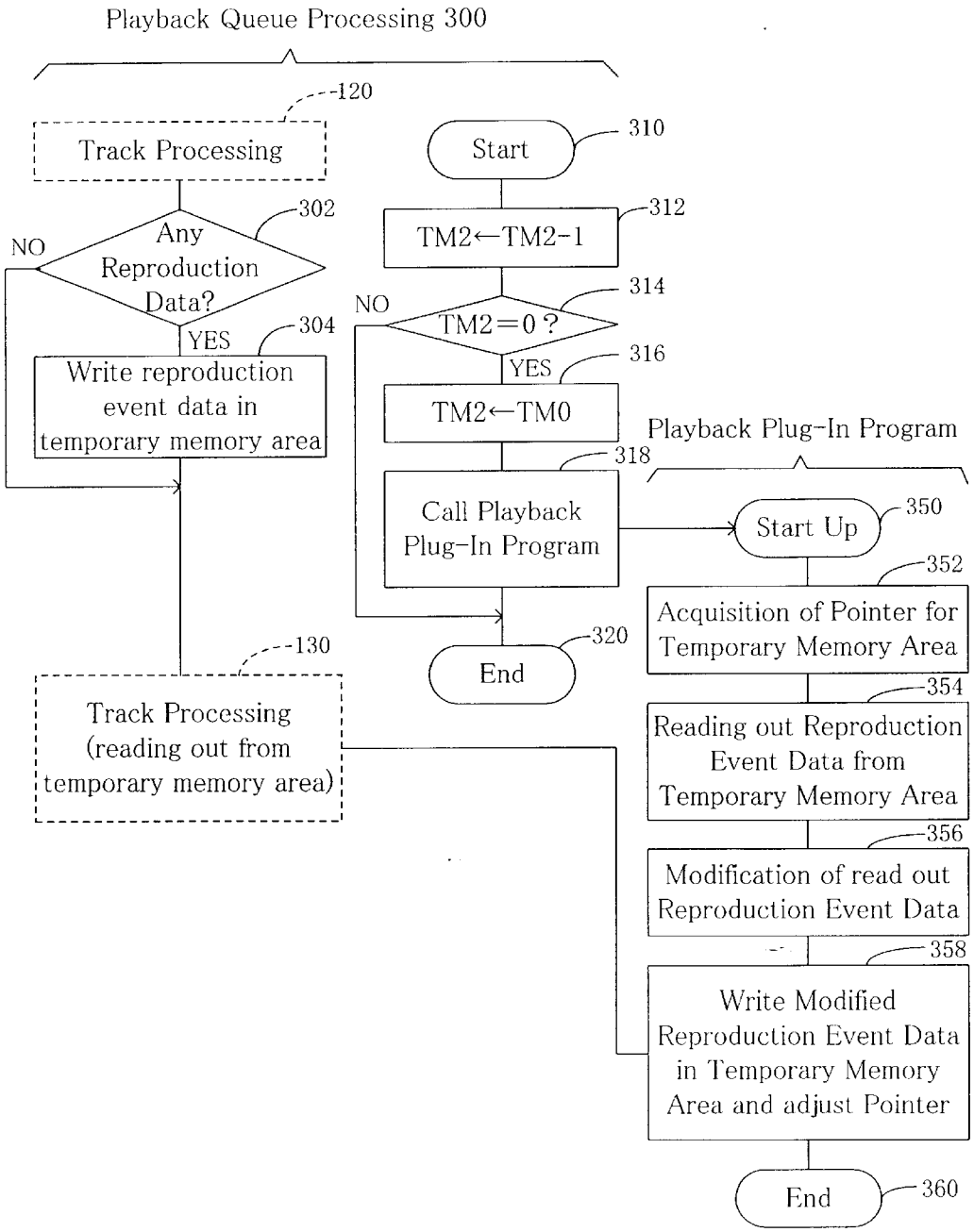
FIG. 7 is a flow chart showing the playback queue processing and execution process of the playback plug-in program.

An example of the playback processing will be explained in the following. FIG. 3 and FIG. 7 show a flow chart of a sequencer program joined with a playback plug-in program. In the playback queue processing at step 300, at step 302 a determination will be given on whether or not any music performance data exist to be reproduced, namely whether or not any event data of reproduction exist. Such music performance data to be determined have been inputted from external unit or have been read out from Music Performance Data Memory Area 50 through record/reproduction processing at the step 120. If any event data of reproduction are found, the determination becomes "YES" at step 302, and then at step 304 the event data of reproduction(=musical performance data to be reproduced) are written in Temporary Memory Area 300*a*, to accumulate there the event data sequentially. If Temporary Memory Area 300*a* is filled with event data of reproduction, the oldest data will then be erased. In case when no event data of reproduction are found, then the determination at step 302 becomes "NO" to advance the program to step 130.

In the playback queue processing, a set of processing at steps 310–320 is executed repetitively at predetermined short time intervals, in parallel with the processing at steps 302 and 304. In the processing at steps 310–320, the elapse of designated time is measured based on Time Count Value TM2 by processing of steps 312–316 in the same way as the processing of steps 212–216. At each elapse of the designated time, the pointer regarding the event data of reproduction(=music performance data to be reproduced) memorized in the Temporary Memory Area 300*a* is transferred to playback plug-in program as argument address, then the playback plug-in program is called up at step 318. In other words, the playback plug-in program is commanded to start up when the pointer is transferred to the program.

The execution of this playback plug-in program begins with its starting up at step 350 by the calling up. It acquires then, at step 352, the pointer regarding event data of reproduction(=music performance data to be reproduced) memorized in the Temporary Memory Area 300*a*. At step 354, the event data of reproduction memorized in Temporary Memory Area 300*a* are read out according to the acquired pointer. At step 356 then, the read out event data of reproduction are modified. In this modification processing, a part of the event data of reproduction can be changed in order to modify musical sound elements such as pitch, sound volume, timbre of musical sound to be reproduced according to event data of reproduction, and new music performance data can be added to the event data of reproduction. Subsequently, new music performance data expressing various musical effects can be added to the event data of reproduction in order to introduce desired musical effects to musical sound to be reproduced. In order to let join additional sounds(e.g. counter melody sound) in melody sound reproduced according to event data of reproduction, sound series of melody and accompaniment expressed by the event data of reproduction are automatically analyzed(by a specific program) to generate new music performance data for proper additional sounds, which are to be added to the event data of reproduction.

After the processing at step 356, the modified event data of reproduction are written in Temporary Memory Area 300*a* at step 358. The pointer in Temporary Memory Area 300*a* is then adjusted and the execution of the playback plug-in program is completed at step 360. When the event data of reproduction are newly written in the Temporary Memory Area 300*a*, the new data can either be processed as additional data to already written event data of reproduction, or all or a part of the old data can be replaced by a new set of data which include the new data. Thus, the event data of reproduction written in Temporary Memory Area 300*a* at step 304 in the playback queue processing are eventually replaced by modified event data of reproduction at step 356 of the playback plug-in program.

Accordingly, in the track processing at the step 130, such modified event data of reproduction are read out from Temporary Memory Area 300*a* and processed by the track processing. After the track processing, the modified event data of reproduction are used in the output queue processing of step 400 and in the external/sound source output processing of step 140. In other words, the modified event data of reproduction (music performance data) are outputted to external units and/or are reproduced in Sound Source Circuit 24. In such a way a user can modify variously the music performance data for reproduction inputted from external devices or read out from Music Performance Data Memory Area 50.

The output queue processing at step 400 corresponds to queuing means of this invention, is located between track processing at step 130 and external/sound source output processing at step 140. In this step 400, a series of music performance data processed by the track processing at step 130 is temporarily memorized sequentially from one part of music performance data to another, in Temporary Memory Area 400*a* allocated in RAM 33. It is also executed in this step 400 to transfer the pointer as an argument address regarding the memorized part of music performance data to the plug-in program which is in this case a function expansion module. Then the plug-in program is called up to read out the music performance data from Temporary Memory Area 400*a* and to write the music performance data in Temporary Memory Area 400*a*. Therefore, in the external output(sound source) processing at step 140, music performance data temporarily memorized in Temporary Memory Area 400*a*, which is written in by the queue processing at step 400, is read out to output to an external device or to Sound Source Circuit 24. In addition, the plug-in program as a function expansion module can call up, on the other hand, the output queue processing by transferring a common argument address.

Figure 8:
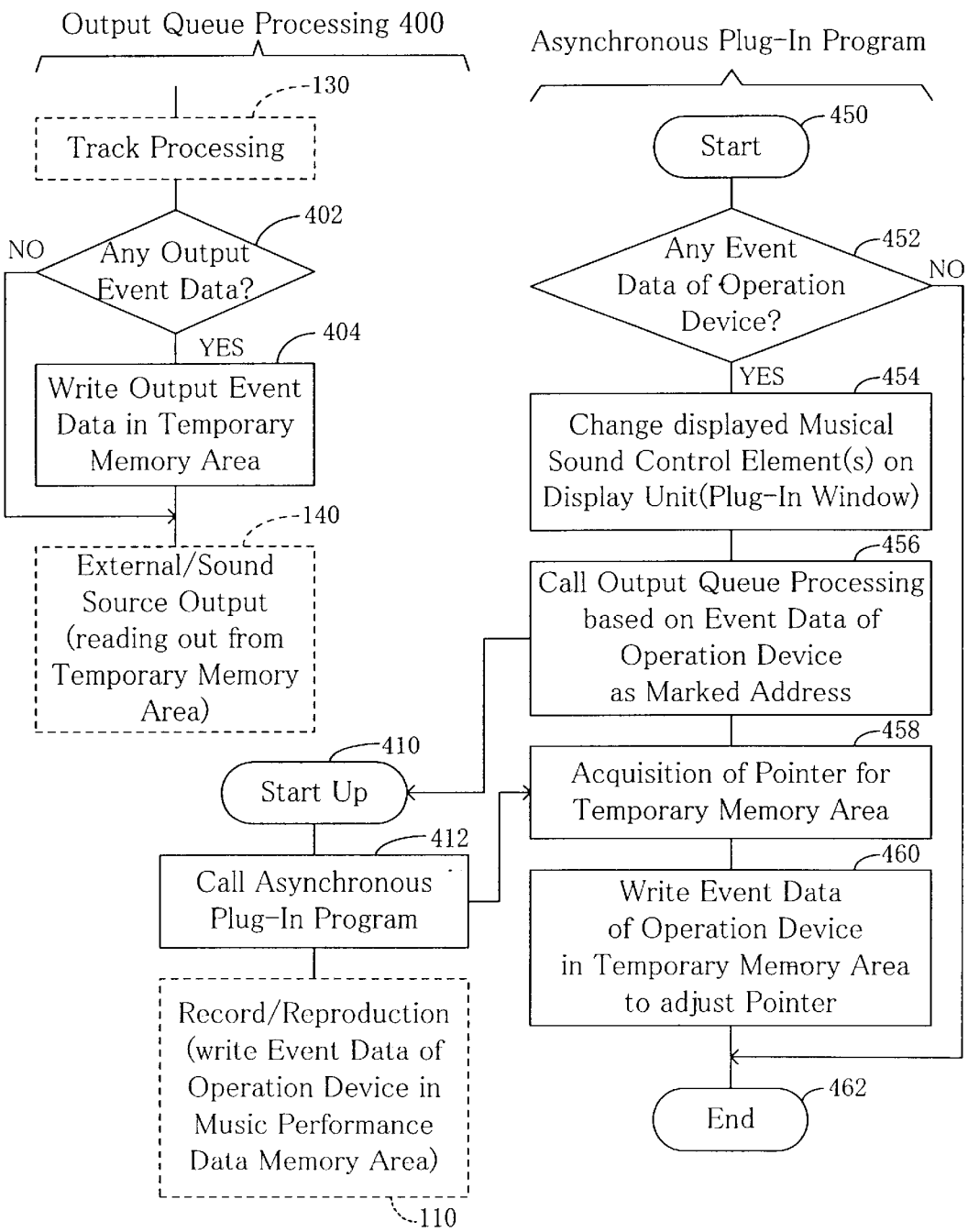
FIG. 8 is a flow chart showing the output queue processing and execution process of the asynchronous plug-in program.

An example of the output queue processing will be explained in the following. Both FIG. 3 and FIG. 8 show a flow chart of a sequencer program joined with an asynchronous plug-in program. In the output queue processing at step 400, at step 402 a determination will be given on whether or not any new music performance data exist to be outputted to an external device or Sound Source Circuit 24 after the track processing at the step 130, namely whether or not any event data of output exist.

If any event data of output are found, the determination becomes "YES" at step 402, and then at step 404, the event data of output(=musical performance data to be outputted) are written in Temporary Memory Area 400*a*, to accumulate there such event data sequentially. If Temporary Memory Area 400*a* is filled with event data of input, the oldest data will then be erased. In case when no event data of output are found, then the determination at step 402 becomes "NO" to advance the program to step 140.

Along with the above-described output queue processing, an asynchronous plug-in program, as a function expansion module, is executed repetitively at predetermined short intervals according to indications which are not shown in the figure. This asynchronous plug-in program starts up at step 450, modifies, by operation of Keyboard 12 and Mouse 13, musical sound control elements of generated musical sound which are displayed in programmable window of Display Unit 14 so that musical sound elements of generated musical sound may be modified in real time with music performance. The musical sound elements include sound volume, timbre of each track(for each part of music performance), for example.

The asynchronous plug-in program starts execution at step 450. Then at step 452, a determination on whether or not any of musical sound control elements have been changed by operation of the Keyboard 12 or Mouse 13, namely whether or not any event data of operating device (=music performance data corresponding to musical sound control elements changed by operation device) exist. In case when no event data of operating device are found, then the determination at step 452 becomes "NO" to once finalize the execution of the asynchronous plug-in program at step 462.

On the other hand, if any event data of operating device are found, the determination at step 452 becomes "YES" so that musical sound control element displayed on the plug-in window of Display Unit 14(e.g. display showing operating device position of sound volume control element) may be changed by operation of Keyboard 12 or Mouse 13. Subsequently, the output queue processing is called up at step 456 taking the event data of operation device(music performance data signifying the changed musical sound control element) as argument, to wait for the next step.

In the output queue processing, a part of the program is started up firstly at step 410. Then at step 412, the pointer regarding event data of output(=music performance data to be outputted) memorized in the Temporary Memory Area 400*a* is transferred to the asynchronous plug-in program as argument address, then the asynchronous plug-in program is called up. In other words, the processing of the asynchronous program is requested, when the pointer is transferred to the asynchronous plug-in program.

For this process, the asynchronous plug-in program receives, at step 458, the pointer regarding event data of output(=music performance data to be outputted) memorized in the Temporary Memory Area 400*a*. At the next step 460, the event data of operation device(=music performance data) is written in Temporary Memory Area 400*a*, or the music performance data already written in Temporary Memory Area 400*a* is changed into new event data of operation device, then the pointer of Temporary Memory Area 400*a* is adjusted. At step 462, the execution of this asynchronous plug-in program is once completed.

Through the above-described process, the new event data of operation device are added to the event data of output memorized in Temporary Memory Area 400*a* by the output queue processing of step 404, or a part of the event data of output is replaced by the event data of operation device.

Accordingly, in the external/sound source output processing at step 140, because such added or replaced event data of output are read out from Temporary Memory Area 400*a* to output them to external unit or Sound Source Circuit 24, the music performance data outputted to external unit or Sound Source Circuit 24 are modified into the data including the event data of operation device. Consequently, the user can change in real time the music performance data to be outputted to external unit, and can modify musical sound elements outputted from Sound Source Circuit 24 in real time by operating Keyboard 12 or Mouse 13.

In contrast thereto, the sequencer program is capable of executing record/reproduction processing of step 110, after the processing at step 412. It is therefore possible for the sequencer program to write the event data of operation device(music performance data corresponding to modified musical sound control elements) which come from the asynchronous plug-in program in Music Performance Data Memory Area 50. By this processing, it is possible to record the music performance data provided from external source together with the event data of operation device in Music Performance Memory Area 50 without being influenced by the input queue processing of step 200 and/or by the playback queue processing of step 300. It is also possible to add the event data of operation device according to operation of external operation devices to the music performance data already recorded in Music Performance Data Memory Area 50.

As explained in the above, the described embodiment executes input queue processing, playback queue processing and output queue processing. Each one of such processing temporarily memorizes a part of music performance data found among a series of music performance data, during each processing in elapse of time, in Temporary Memory Areas 200*a*, 300*a* and 400*a*. The pointer regarding the memorized part of music performance data is transferred as argument to each corresponding program which takes a role of function expansion module. The music performance data are read out from Temporary Memory Areas 200*a*, 300*a* and 400*a* respectively and are written in the Temporary Memory Area 200*a*, 300*a* and 400*a* respectively. by each plug-in program. It is also possible by various plug-in programs such as the above-cited plug-in programs to add easily any of expanded functions to the basic sequence processing(=record and reproduction processing for automatic play), if the various programs having a role of function expansion module are capable, just as the above-cited plug-in programs are, of receiving the pointer regarding the part of music performance data memorized in Temporary Memory Area 200*a*, 300*a* and 400*a*, and of either reading out the music performance data from the Temporary Memory Area 200*a*, 300*a* and 400*a*, or writing the music performance data in the Temporary Memory Area 200*a*, 300*a* and 400*a*.

In the aforementioned explanation on the online processing, all kinds of queue processing are disposed for a whole music performance data, and each specific plug-in program is added to each of all kinds of queue processing. However, it is also possible in this type of embodiment to dispose each queue processing for each track, and add a proper plug-in program independently for each track. Further, it is also applicable, as one of variations of the embodiment, to control the wire-connected plug-in programs by both adding plural plug-in programs for each one of queue processing and managing the order of calling up from each queue processing (=sequencer program).

Figure 9:
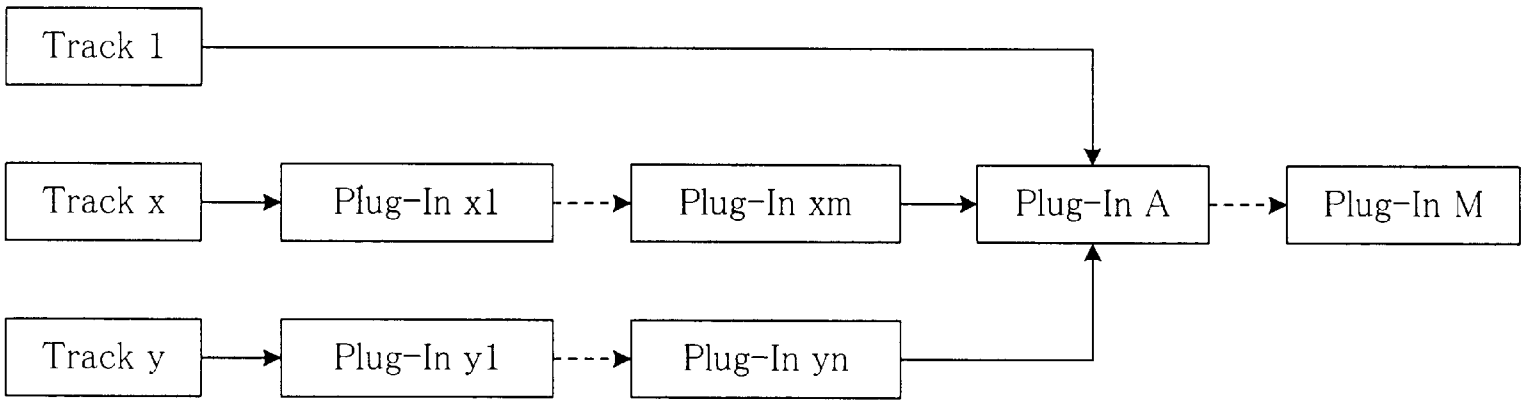
FIG. 9 is a diagram showing logical connection of plug-in programs related to one of variations of the embodiment.

FIG. 9 shows an example of the above described variation of logical wiring. As shown in FIG. 9, the sequencer program calls up, one by one, during previously designated queue processing (e.g., input queue processing, playback queue processing), plug-in programs x1-xm for the track "x" located at the x-th order among a plurality of tracks. In parallel with this processing are called up also plug-in programs y1-yn, one by one, for the track "y" located at the y-th order among a plurality of tracks. Each one of the plug-in programs x1-xm and y1-yn executes its proper function expansion processing for the queue processing of track "x", "By". Then, the sequencer program calls up, one by one, the plug-in programs A–M provided for all tracks. The sequencer program of basic function can thus have various expanded functions.

The relationship between the queue processing and the plug-in program can be determined with Display Unit 14. It is recommended for this purpose that the user, after having installed the sequencer program and various plug-in programs in Personal Computer PC1, establishes a desired relationship between a queue processing and various plug-in programs by monitoring Display Unit 14 which shows the updated temporary relationship. Thus, a desired relationship can easily be established between a queue processing and plug-in programs, still keeping the possibility of easy modification of the once established relationship.

New queue processing which is similar to various queue processing adopted in the above sequencer program can be provided to the plug-in program as a function expansion module in this embodiment. In this case, a certain plug-in program can call up another plug-in program which is joined with the sequencer program. This is another function expansion of the sequencer program, which could result in many and complicated function expansions easily attainable.

b. Offline Processing

Figure 10:
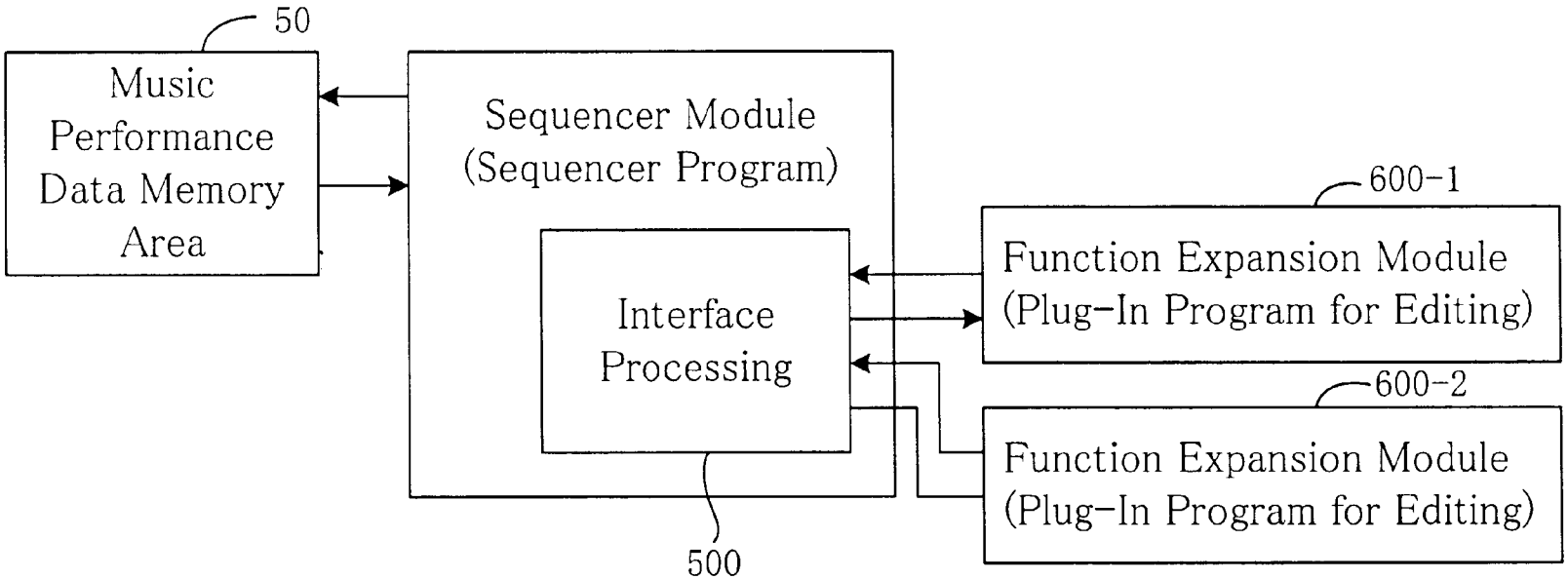
FIG. 10 is a conceptual diagram showing connection of sequencer module and function expansion modules in the offline processing case.

The explanation on the offline processing will be given in the following paragraph with reference to the accompanying drawings. FIG. 10 is a conceptual figure showing the relationship between a sequencer module(=sequencer program) and a function expansion module(=plug-in program for editing) in the offline processing status.

The sequencer module has not only a function of recording music performance data provided from external device with elapse of time in Music Performance Data Memory Area 50 as well as that of reproducing music performance data memorized in Music Performance Data Memory Area 50, but also another function of Interface Processing 500 which enables bringing additional Function Expansion Modules 600-1, 600-2 etc. Function Expansion Modules 600-1 & 600-2 enable the music performance data memorized in Music Performance Data Memory Area 50 to be edited via the sequencer module. In Music Performance Data Memory Area 50, music performance data are memorized in a form of triple layered data structure, namely, in three layers consisting of track, block and event data. This triple structure can adopt, if each one of music performance data can be designated based on the triple layered structure for Music Performance Data Memory Area 50, whatever arrangement the music performance data may take in Music Performance Data Area 50. The sequencer module and Function Expansion Modules 600-1 & 600-2 can call up each other by referring a common argument and common functions.

Figure 11:
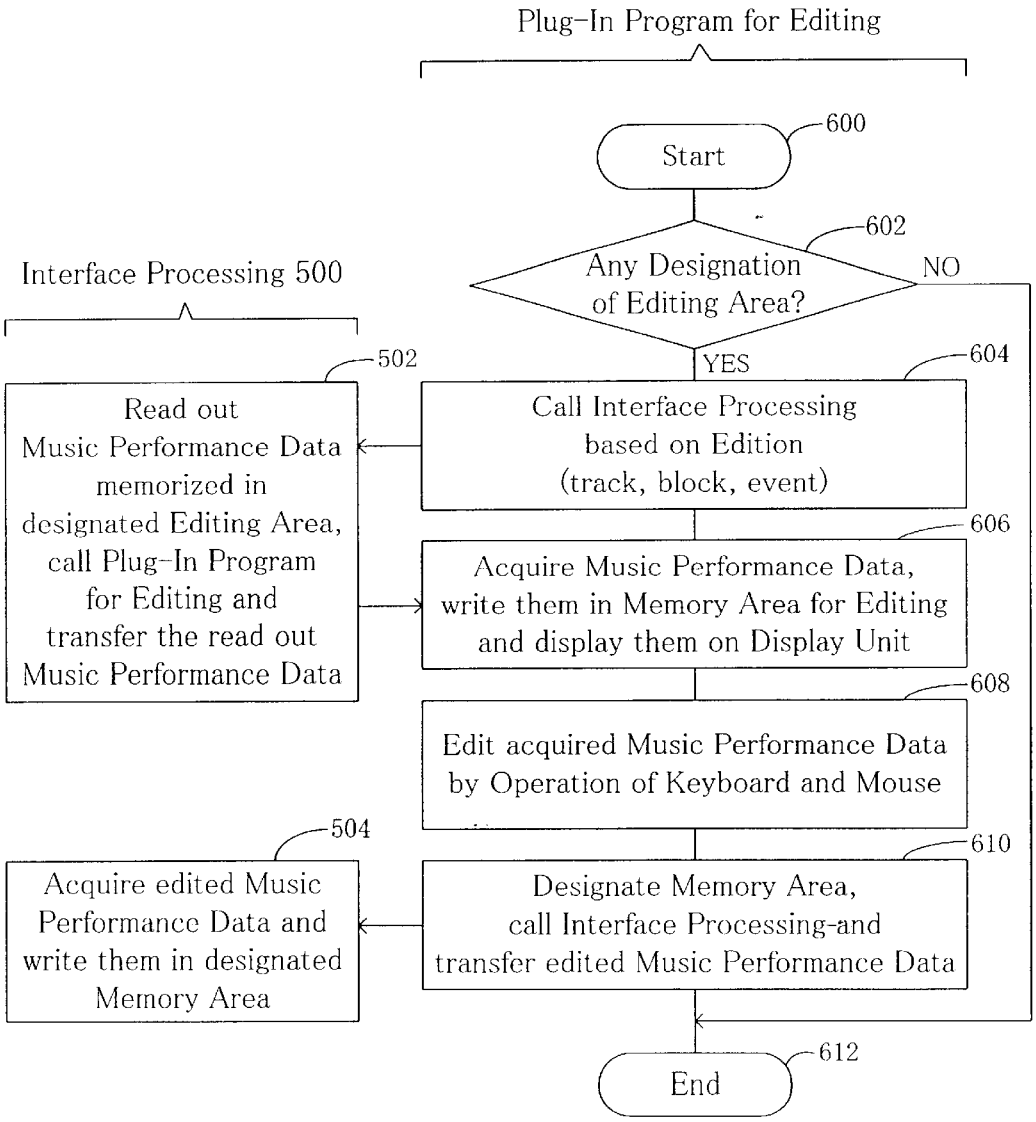
FIG. 11 is a flow chart showing the interface processing and execution process of the plug-in program for editing; and, FIG. 12 is a conceptual diagram showing music performance data flow to be edited.

Such relationship between the sequencer module and Function Expansion Modules 600-1 & 600-2 will be further explained with a help of the flow-chart in FIG. 11. As described in the above, the plug-in program for editing (Function Expansion Modules 600-1 & 600-2) and Interface Processing 500 of the sequencer program can call up each other referring a common argument and common functions, and the plug-in program for editing can be executed repetitively with a prefixed interval. At step 600 the execution of the plug-in program for editing starts up. At step 602, a determination will be given on whether or not the memory area of music performance data to be edited(=editing area) is designated by operation of the Keyboard 12 or Mouse 13. Display Unit 14 displays instruction for editing the music performance data which helps the user designate the desired editing area using input devices such as Keyboard 12, Mouse 13 etc.

In case when no designation of editing area is found, then the determination at step 602 becomes "NO" to once finalize the execution of the plug-in program for editing at step 612. On the other hand, if any designation of editing area are found, the determination at step 602 becomes "YES" so that the interface processing may be called at step 604 taking track number, block number and event number as arguments corresponding to the editing area. If all music performance data on one or plural tracks are to be edited, the arguments should be only one track number or plural track numbers. And, in case when the designated music performance data to be edited are found on specific one block or plural blocks among the data on one track or plural tracks, the arguments should be one or plural track numbers and block numbers.

In Interface processing 500, the music performance data which belong to the editing area designated by the arguments are read out from Music Performance Data Memory Area 50 at step 502 according to the calling up. Then Interface processing 500 calls up the plug-in program for editing in order to transfer the read out music performance data, and wait for the next step. In the plug-in program for editing, the music performance data read out from the Music Performance Data Memory Area 50 are taken in responding to the calling up at step 606. The taken music performance data are then written in the memory area for editing reserved appropriately in RAM 33 and are displayed by Display Unit 14.

In such environment the user is allowed to edit the music performance data by monitoring the screen of Display Unit 14 through his operation of Keyboard 12 or Mouse 13. After the above step 606, by operation of Keyboard 12 or Mouse 13, the music performance data stored in the memory area for editing are edited at step 608. Displayed information on Display Unit 14 also changes according to the user's operation at the same time.

Subsequently, according to the user's indication of completion of editing, Interface Processing 500 is called up after having designated the memory area in Music Performance Data Memory Area 50 which the music performance data edited is memorized in at step 610. The edited music performance data, in the triple layered structure, is transferred to the Interface Processing 500 together with the data signifying the designated memory area. The execution of the plug-in program of editing is completed at step 612.

With regard to the data corresponding to the designated memory area, if the newly edited music performance data are only returned to the designated area for editing, the data corresponding to the designated area for editing are used again. When a part of music performance data memorized in Music Performance Data Memory Area 50 is copied or modified to be written in a different area, new data expressing the memory area which is newly designated by the user are to be generated.

Figure 12:
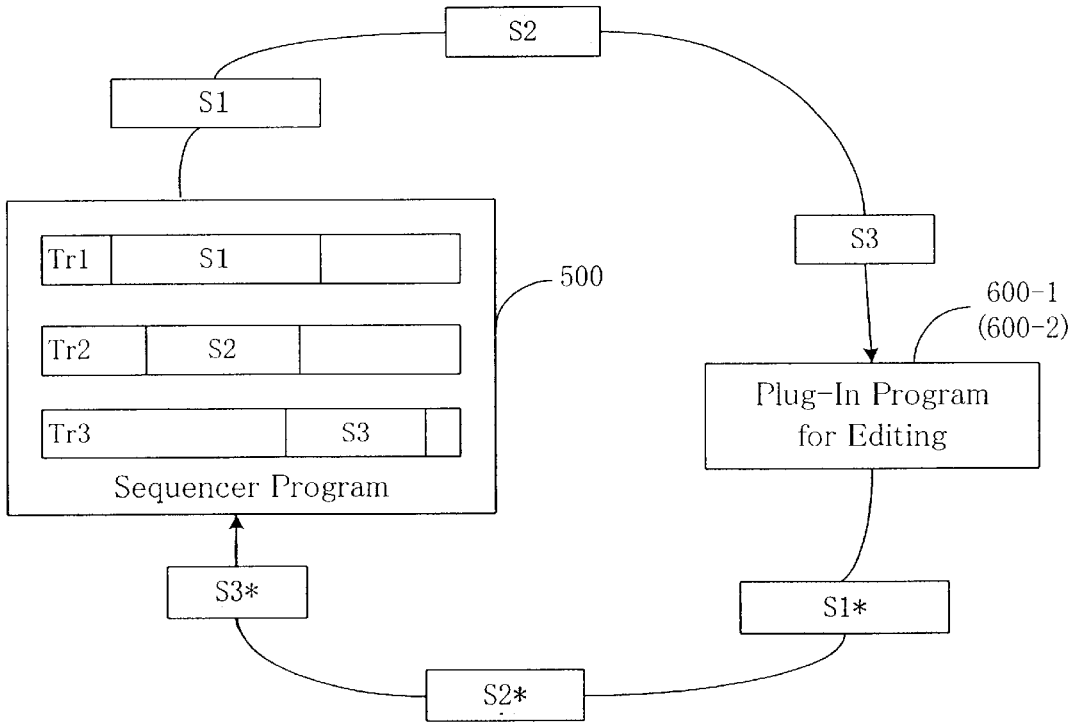

In Interface Processing 500, responding to the above calling up, the edited music performance data are taken in at step 504, to be written in the designated memory area located in Music Performance Data Memory Area 50. Therefore, the music performance data in Music Performance Data Memory Area 50, by way of Interface Processing 500 in the sequencer program, are allowed to be edited in the plug-in program for editing. FIG. 12 shows the flow of the music performance data in the process of editing. In this chart, several parts S1, S2 and S3 of the music performance data memorized in Music Performance Data Memory Area 50 are edited into S1*, S2* and S3* respectively by the processing of the plug-in program for editing and are memorized again in Music Performance Data Memory Area 50 after the editing.

As it is understandable by above-mentioned explanation, if once a part of music performance data are selectively designated from Music Performance Data Memory Area 50 by the plug-in program for editing which takes a role of function expansion module, using a function in a form of triple layered structure, then Interface Processing 500 of the sequencer program which takes a role of a sequencer module transfers the designated part of music performance data from Music Performance Data Memory Area 50 to the plug-in program for editing. After this process, the part of the music performance data is edited by the plug-in program for editing, sent back to Interface Treatment 500, and written in Music Performance Data Memory Area 50.

In summery, by only adding the plug-in program as a role of function expansion module to a sequencer module (=sequencer program), a function expansion can universally and easily be realized in order to edit the music performance data. Moreover, a multitude of plug-in programs which work as various function expansion modules can be universally and easily applied, because such additional plug-in program can be adopted in sequencer program only by designating a common argument and common function with the sequencer program.

It can be finally mentioned that, in this offline processing also, just as it is suggested in the above explanation about display of the music performance data on Display Unit 14, it is possible to take the music performance data memorized in Music Performance Data Area 50 in the plug-in program and to simply monitor them. This shows, as an example, that a function expansion can universally and easily in the function of monitoring the music performance data.

Lastly, this invention may be practiced or embodied in still other ways without departing from the spirit or essential character thereof as described heretofore. Therefore the preferred embodiment described herein is illustrative and not restrictive, the scope of the invention being indicated by the appended claims and all variations which come within the meaning of the claims are intended to be embraced therein.

What is claimed is:

1. An automatic play apparatus for recording and reproducing a series of music performance data, said automatic play apparatus including queuing means and a memory area, said queuing means comprising:

memorizing means for memorizing temporarily a part of said series of music performance data in said memory area during said series of processing, and transferring means for transferring an argument address to said temporarily memorized music performance data in said memory area to a function expansion module so that said function expansion module can read out said temporarily memorized music performance data from said memory area and write newly established music performance transferred data in said memory area.

2. An automatic play apparatus for recording and reproducing a series of music performance data, said automatic play apparatus including a plurality of queuing means and a memory area, said plurality of queuing means comprising respectively:

memorizing means for memorizing temporarily a part of said series of music performance data in said memory area during said series of processing, and transferring means for transferring an argument address to said temporarily memorized music performance data in said memory area to a function expansion module so that said function expansion module can read out said temporarily memorized music performance data from said memory area and write newly established music performance transferred data in said memory area.

3. An automatic play apparatus according to claim 2, wherein said plurality of queuing means transfer argument addresses to different types of function expansion modules.

4. A function expansion device applied to an automatic play apparatus for recording and reproducing a series of music performance data, said device comprising:

receiving means for receiving an argument address to a part of said music performance data memorized temporarily in a memory area during said series of processing, data reading means for reading out said memorized music performance data from said memory area based on said argument address.

5. A function expansion device according to claim 4, further comprising:

monitoring means for monitoring said read out music performance data.

6. A function expansion device applied to an automatic play apparatus for recording and reproducing a series of music performance data, said device comprising:

receiving means for receiving an argument address to a part of said music performance data memorized temporarily in a memory area during said series of processing, data reading and writing means for reading out said memorized music performance data from said memory area and for writing newly established music performance data in said memory area based on said argument address.

7. A function expansion device according to claim 6, further comprising:

modifying means for modifying said read out music performance data to establish newly musical performance data.

8. A computer readable program storage medium storing a queue program applied to an automatic play apparatus for recording and reproducing a series of music performance data, said automatic play apparatus including a memory, said queue program containing executable instructions for causing a computer to perform the steps of:

memorizing temporarily a part of said series of music performance data in said memory during said series of processing, and transferring an argument address to said temporarily memorized music performance data in said memory area to a function expansion module so that said function expansion module can read out said temporarily memorized music performance data from said memory area and write newly established music performance data in said memory area.

9. A computer readable program storage medium according to claim 8, wherein said queue program is incorporated in said series of processing.

10. A computer readable program storage medium storing a function expansion program applied to an automatic play apparatus for recording and reproducing a series of music performance data, said function expansion program containing executable instructions for causing a computer to perform the steps of:

receiving an argument address to a part of said music performance data memorized temporarily in a memory area during said series of processing, reading out said memorized music performance data from said memory area based on said argument address.

11. A computer readable program storage medium according to claim 10, said function expansion program further containing the step of:

monitoring said read out music performance data.

12. A computer readable program storage medium storing a function expansion program applied to an automatic play apparatus for recording and reproducing a series of music performance data, said function expansion program containing executable instructions for causing a computer to perform the steps of:

receiving an argument address to a part of said music performance data memorized temporarily in a memory area during said series of processing, reading out said memorized music performance data from said memory area based on said argument address, writing newly established music performance data in said memory area based on said argument address.

13. A computer readable program storage medium according to claim 12, said function expansion program further containing the step of:

modifying said read out music performance data to establish newly musical performance data.

* * * * *